US005992336A

United States Patent [19]

Ramme

[11] Patent Number: 5,992,336

[45] Date of Patent: Nov. 30, 1999

[54] REBURNING OF COAL ASH

[75] Inventor: Bruce W. Ramme, Okauchee, Wis.

[73] Assignee: Wisconsin Electric Power Company, Milwaukee, Wis.

[21] Appl. No.: 08/775,314

[22] Filed: Dec. 31, 1996

[51] Int. Cl.[6] ..... F23J 3/00

[52] U.S. Cl. ..... 110/344; 110/165 A; 110/165 R; 110/342; 110/347; 106/DIG. 1

[58] Field of Search ..... 110/165 A, 341, 110/342, 344, 347, 165 R; 106/DIG. 1

[56] References Cited

U.S. PATENT DOCUMENTS

| | | | |
|---|---|---|---|
| 1,936,741 | 11/1933 | Wood | 110/165 A |
| 2,493,960 | 1/1950 | Gladden | 110/165 A |
| 2,592,701 | 4/1952 | Jackson | 110/165 A |
| 2,686,499 | 8/1954 | Sparks | 110/165 A X |
| 2,750,903 | 6/1956 | Miller et al. | 110/165 A |
| 2,917,011 | 12/1959 | Korner | 110/165 A X |
| 3,965,829 | 6/1976 | Lees | 110/342 |
| 4,508,041 | 4/1985 | Voetter et al. | 110/347 |
| 4,705,409 | 11/1987 | Trerice | 374/45 |
| 4,981,111 | 1/1991 | Bennett et al. | 110/347 |
| 5,024,169 | 6/1991 | Borowy | 110/165 A |
| 5,090,338 | 2/1992 | Harada et al. | 110/165 A |
| 5,160,539 | 11/1992 | Cochran | 106/405 |
| 5,161,471 | 11/1992 | Piekos | 110/165 R |
| 5,390,611 | 2/1995 | John | 110/165 A |
| 5,399,194 | 3/1995 | Cochran et al. | 106/405 |
| 5,484,476 | 1/1996 | Boyd | 106/405 |
| 5,511,495 | 4/1996 | Kinto et al. | 110/165 A |
| 5,749,308 | 5/1998 | Bachik | 110/165 A X |

FOREIGN PATENT DOCUMENTS

| | | | |
|---|---|---|---|
| 25 36 832 | 3/1977 | Germany | 110/165 A |
| 53-87580 | 8/1978 | Japan | 110/344 |
| 58-85011 | 5/1983 | Japan | 110/165 A |
| 1-304094 | 12/1989 | Japan | 110/344 |

OTHER PUBLICATIONS

"Ash Volume Reduction and Boiler Efficiency Improvement by Ash Reburning", Stanley J. Piekos, P.E., Oct. 1991.

*Primary Examiner*—Carl D. Price
*Assistant Examiner*—Ljiljana V. Ciric
*Attorney, Agent, or Firm*—Quarles & Brady

[57] ABSTRACT

Bottom ash and flyash having high LOI is reburned in a pulverized coal furnace. The bottom ash is added to the coal supply before the coal is pulverized. Flyash is added to the pulverized coal stream for injection with the pulverized coal or is separately injected into the furnace at or slightly above the level of the coal burners in the furnace. The bottom ash and flyash is added to the coal in direct proportion of 1% to 3.5% of the coal.

5 Claims, 3 Drawing Sheets

REBURNING OF COAL ASH

BACKGROUND OF THE INVENTION

This invention relates to the treatment of coal ash, and particularly to a method for reburning bottom ash and flyash components of coal to remove carbon and provide a usable end product.

Coal fired boilers are widely used to generate steam for producing electricity. A common form of boiler uses a pulverized coal that is injected into a furnace. Millions of tons of coal ash result each year from such operations. The coal ash includes flyash with a minor proportion of bottom ash. Some of the ash is commercially usable in concrete, concrete products, cement production, sewage sludge stabilization, pavement base materials, lightweight aggregate, and other miscellaneous purposes. The remaining coal ash must generally be disposed of by landfilling since it has no commercial value. A principal reason for a lack of commercial value for coal ash is the presence of unburned carbon in the ash. According to ASTM Standard C618, an ash must have a Loss On Ignition (LOI) value no higher than 6% for use in concrete. An upper limit of 3% is more realistic. Higher LOI ash cannot be used because of color problems and concerns for durability under freezing and thawing conditions.

The residual carbon content in the coal ash depends upon a variety of factors including base line furnace operation and boiler design. It also depends upon the source of the coal fuel. For example, subbituminous western coal, when burned, will typically result in a low carbon ash with an LOI of less than 5%.

A variety of methods for dealing with the high carbon flyash problem are currently under investigation. The methods include froth flotation which uses mining technology for separation of materials of different densities, electrostatically-charged belts to separate carbon from the flyash, a fluidized bed separation using acoustical techniques, and combustion of the remaining carbon in the flyash in a fluidized bed boiler designed specifically for that purpose. None of these technologies have demonstrated the ability to completely remove the LOI on a commercial scale, and all of these approaches would require significant capital and operating costs.

It is a principal object of the invention to provide a method of treating high carbon coal ash using existing capital installations, and particularly existing pulverized coal boilers.

SUMMARY OF THE INVENTION

In accordance with the invention, coal ash, either flyash or bottom ash or a mixture of both, is added in a fine particle condition to the furnace of a pulverized coal boiler in a small proportion to the pulverized coal fed to the furnace. The ash is burned with the pulverized coal. The proportion of coal ash is preferably in the range of 1% to 3.5%, by weight, of the pulverized coal.

The relatively course bottom ash may be introduced with the coal upstream of the pulverizers, while the finer flyash can be introduced with the pulverized coal stream before the stream enters classifiers, or with the pulverized coal stream fed to each burner, or with a secondary air flow stream entering the furnace adjacent to the coal diffusers of each burner, or through independent injection ports located above or adjacent to the coal stream burners.

High LOI coal ash will be reduced by the method of this invention to an LOI of 1% to 2% or less. The fuel value that remained in the high carbon coal ash is utilized and the ash is transformed from a material that must be landfilled to one that can be sold and utilized.

The invention also resides in a method of generating steam by burning pulverized coal in a boiler that includes adding a small proportion of a high LOI coal ash to the boiler to be burned with the pulverized coal.

The foregoing and other objects and advantages of the invention will appear in the detailed description which follows. In the description, reference is made to the accompanying drawings which illustrate preferred embodiments of the invention.

DETAILED DESCRIPTION OF THE PREFERRED EMBODIMENTS

Figure 1:
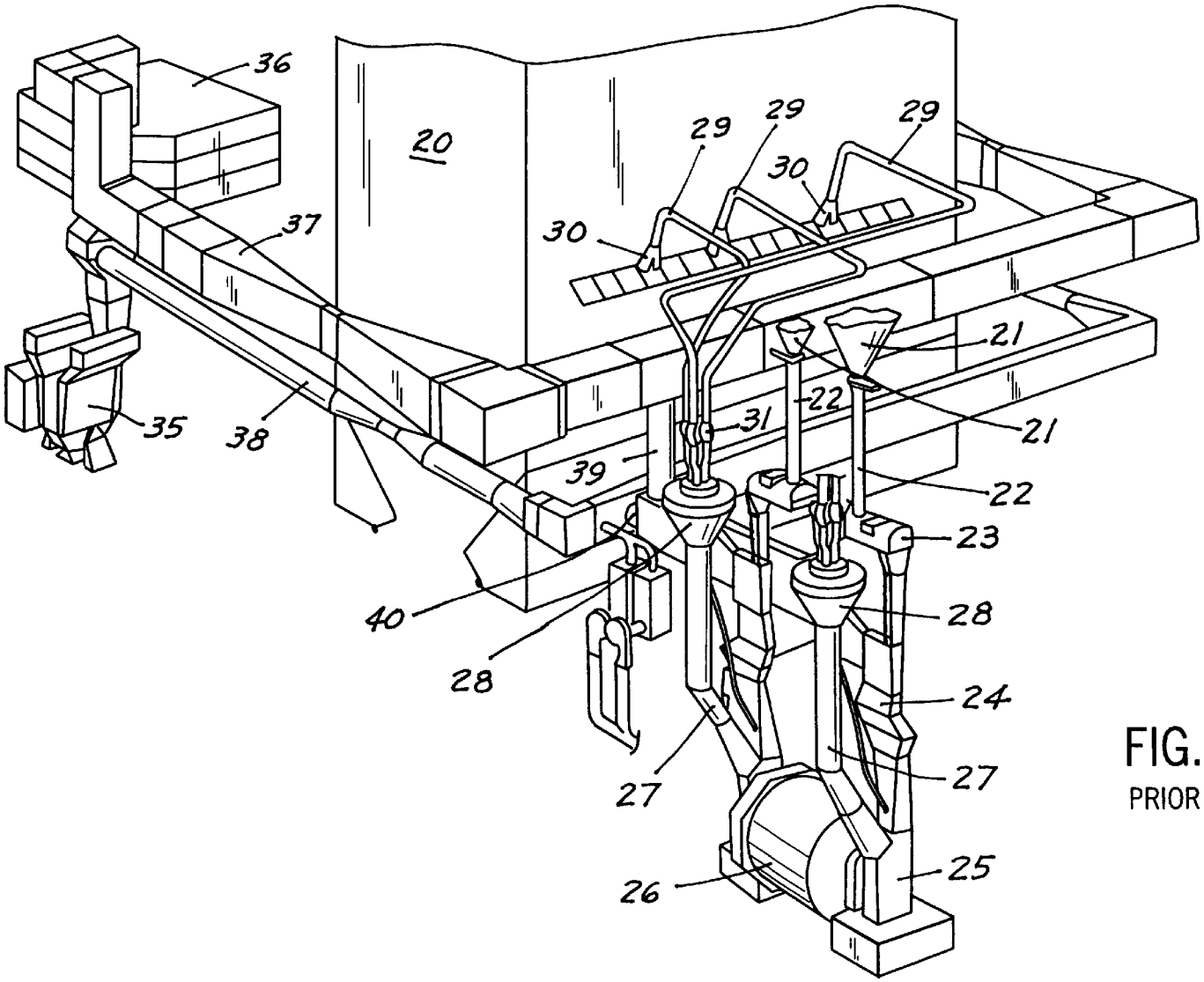
FIG. 1 PRIOR ART
FIG. 1 is a view in perspective of a portion of a typical pulverized coal fired furnace which may be modified to carry out the method of the present invention.

One power generating plant of Wisconsin Electric Power Company burns pulverized bituminous coal for injection into the furnace of a steam generating boiler. Examples of the ultimate analysis and proximate analysis for two bituminous coals used at this plant are as follows:

TABLE I

BITUMINOUS COALS ULTIMATE ANALYSIS %

| | Coal A | Coal B |
|---|---|---|
| Moisture | 9.30 | 0 |
| Ash | 9.20 | 6.90 |
| Hydrogen | 4.50 | 5.07 |
| Nitrogen | 1.40 | 1.50 |
| Sulfur | 0.58 | 1.83 |
| Carbon | 65.50 | 78.66 |
| Oxygen | 9.52 | 6.04 |
| | 100.00 | 100.00 |

TABLE II

BITUMINOUS COALS PROXIMATE ANALYSIS SPECS. %

| | Coal A | Coal B |
|---|---|---|
| Moisture | 9.30 | 7.00 |
| Ash | 9.20 | 6.50 |
| Volatile | 35.00 | 34.50 |
| Fixed Carbon | 46.50 | 50.00 |
| Sulfur | 0.58 | 1.70 |
| Btu/lb. | 11,650 | 13,150 |

Analysis of bottom ash from the furnaces burning bituminous coal show a bottom ash with an LOI of 44.8%, with an energy content of 2,860 Btu/lb. and a moisture content of 56.1%. The flyash from this power generating plant has an LOI of 66.4%, contains 4,464 Btu/lb., and has a moisture content of 4.9%. Both the flyash and bottom ash from this plant are unsuitable for commercial purposes and are presently landfilled.

A second plant of Wisconsin Electric Power Company burns subbituminous coal. Typical ultimate analysis and proximate analysis for two coals used at this plant are as follows:

TABLE III

SUBBITUMINOUS COALS ULTIMATE ANALYSIS %

| | Coal C | Coal D |
|---|---|---|
| Moisture | 30.50 | 29.62 |
| Ash | 5.70 | 5.36 |
| Hydrogen | 3.20 | 3.37 |
| Nitrogen | 0.78 | 1.00 |
| Sulfur | 0.32 | 0.32 |
| Carbon | 48.00 | 49.00 |
| Oxygen | 11.50 | 11.33 |
| | 100.00 | 100.00 |

TABLE IV

SUBBITUMINOUS COALS PROXIMATE ANALYSIS SPECS. %

| | Coal C | Coal D |
|---|---|---|
| Moisture | 30.50 | 29.62 |
| Ash | 5.70 | 5.36 |
| Volatile | 31.10 | 30.96 |
| Fixed Carbon | 32.70 | 34.33 |
| Sulfur | 0.32 | 0.33 |
| Btu/lb. | 8,365 | 8,470 |

Analysis of bottom ash from the furnace burning the subbituminous coals shows an average LOI of 2.4% and a moisture content of 15.3%. The average flyash from such furnaces exhibit an LOI of less than 0.5% and a moisture content of about 0.1%. The LOI is so low on both the bottom ash and flyash that no effort is made to test for the Btu/lb. The flyash from the furnaces burning subbituminous coal is very usable with cement in the formation of concrete products.

The principal purpose of the present invention is to treat high LOI flyash and bottom ash, such as formed from a pulverized coal furnace burning bituminous coal, to render the ash into a usable flyash and bottom ash having very low LOI such as produced in a pulverized coal furnace using subbituminous coals. This is achieved by adding the high LOI coal ashes to the coal stream which normally produces low LOI coal ashes.

The bottom ash and flyash may be handled separately. The bottom ash will typically have a larger particle size and may require grinding to reduce it to the size of the pulverized coal stream. The preferred approach for handling of the bottom ash is to add it to the store of coal prior to the coal being ground. The bottom ash and coal mixture has a grindability index on the Hardgrove scale which is acceptable.

A test was conducted by adding bottom ash having an LOI of 37.9% and a moisture content of 60.0% to loaded coal cars using a front end loader. The bottom ash was added at a ratio of 5% of the coal prior to unloading in a rotary car unloader. The coal cars were then unloaded in a normal manner and the coal was transported by a conveyor system to one of five coal silos. The bottom ash and coal mixture was then milled and injected into the boiler with the fuel stream during normal operations in the furnace along with coal from the other four coal silos and mills that did not contain bottom ash. Thus, the actual ratio of bottom ash to coal transported for combustion was 1% of the overall fuel being burned. The test burning ran smoothly and without incident. The addition of the 1% of bottom ash was not significant from an operational viewpoint. There was no discernable difference in emissions, and the bottom ash coal fuel blend had adequate fineness for combustion.

The flyash from the test reburning of the bottom ash exhibited LOI of between 0.2% and 0.4%, based upon samples taken over two days. This represented very complete combustion of the bottom ash with a resulting LOI that is in the same range as burning coal without bottom ash. The resulting flyash had a calcium oxide content of between 21.4% and 22.6% which is a drop from the normal average of 26%. This was as expected, and the lower calcium oxide content improves properties of the flyash for use in concrete applications. Bottom ash typically represents less than 20% of the coal ash.

High LOI flyash cannot be introduced into the coal upstream of the mills or other pulverizers because of dusting and mixing problems. High LOI flyash can be introduced with the pulverized coal stream entering the pulverizer classifiers. This has the advantage of thorough mixing upstream of the burners and would require only a slight additional volume of air to transport the flyash. High LOI flyash can be introduced with the pulverized coal stream at each burner location. Since each classifier typically feeds several burners, the number of feed points for the flyash would be greater.

High LOI flyash can also be introduced with the secondary air flow stream as it enters the furnace. The secondary air flow with the flyash provides sufficient mixing. The flyash can be introduced through heat-resistant or stainless pipes. The high LOI flyash can also be introduced into the furnace either above or adjacent to the existing burner level through separate pipes. Injection points through a waterwall could be used, although this may require modifications of the waterwalls in the boilers.

Figure 3:
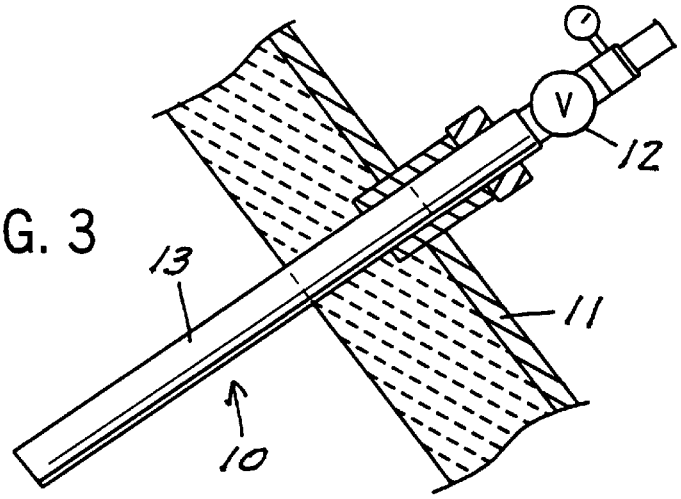
FIG. 3 is a view in elevation of an injection pipe for injecting coal ash into the furnace of FIG. 2.

A flyash having an LOI of 26.5% and a moisture content of 0.3% was introduced into a coal pulverized furnace through injection pipes 10 shown in FIG. 3. The flyash was stored in a horizontal silo from which it was pumped through a five-inch diameter flexible hose for injection through stainless steel pipes extending. through the furnace wall 11 immediately above two coal burners. The hose was connected to a reducer splitter where the five-inch diameter hose was reduced to two two-inch diameter hoses. The smaller hoses were each connected to a ball valve 12 which led to a stainless steel pipe 13. All of the hose connections and joints were grounded to prevent any problems from static charges. The flyash was pumped at a rate of approximately 1% to 2% of the coal flow into the furnace. The addition of the flyash to the combustion process did not affect combustion. The resulting flyash from the reburning had an LOI of between 0.2% and 0.5% based upon samples taken at intervals over four days.

FIG. 1 illustrates a portion of a typical pulverized coal furnace 20 with the pulverized fuel system. The pulverized fuel system includes coal hoppers 21 which connect through a coal spout 22 to a gravimetric feeder 23 which leads to a crusher dryer 24. The crusher dryer 24 extends to a bypass damper 25 which connects to a ball mill 26. The pulverized coal from the ball mill 26 and coal dust from the bypass damper 25 are discharged through coal discharge ducts 27 which lead to a centrifical classifier 28. In the classifier 28, oversized particles are returned to the ball mill 26 for further processing while proper size particles are fed through coal pipes 29 to flame burners 30 that extend into the side of the furnace 20. Stop valves 31 are inserted in the coal pipe lines 29.

A primary air fan 35 forces air through an air heater 36 to a primary air duct 37. A tempering air duct 38 also extends from the fan 35 to the furnace 20. Hot air from the primary air duct 37 is ducted through a hot air damper 39 to the crusher dryers 24 and tempering air is ducted through a damper 40 also to the crusher dryer 24. The air is used to transport the pulverized coal through the coal pipes 29 to the burners 30.

Figure 2:
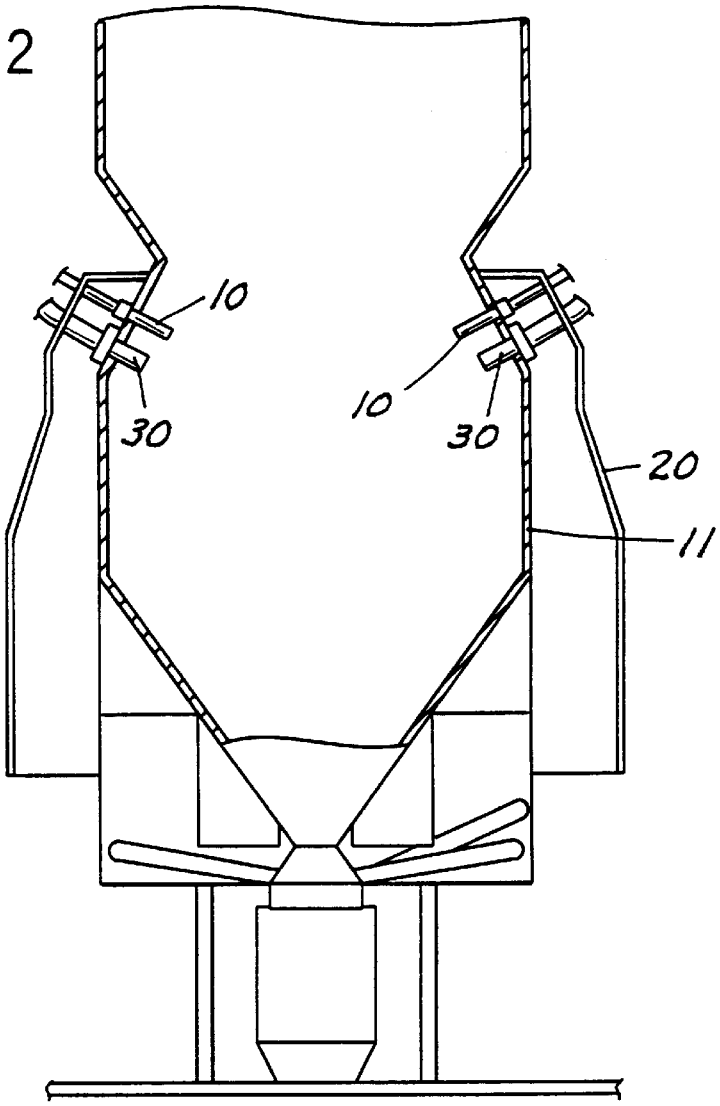
FIG. 2 is a partial view in vertical cross-section of the furnace of FIG. 1 illustrating the location of flyash injection nozzles.
Figure 4:
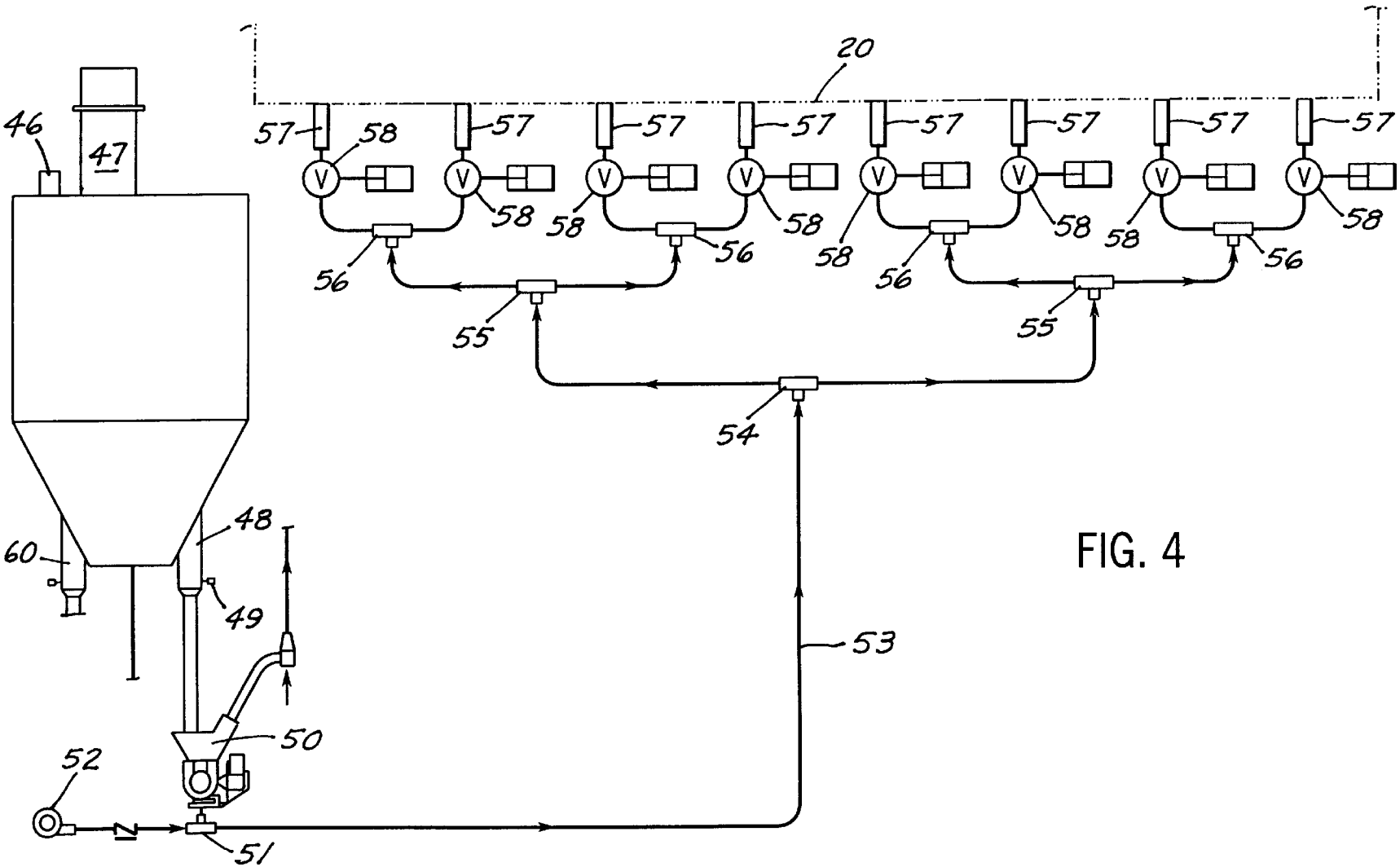
FIG. 4 is a schematic diagram of an installation for carrying out the method of this invention in which coal ash is injected through separate injection lances into the pulverized coal furnace.

Bottom ash may be introduced into the coal hoppers 21 to be processed along with the coal being pulverized. Flyash may be added to the pulverized coal stream at the classifiers 28 or at the coal pipes 29. However, in the preferred arrangement, flyash is injected separately into the furnace 20. Such an arrangement is shown in FIGS. 2 and 4. FIG. 2 shows the typical entry point of the burners 30 into the furnace 20. Injection pipes 10 or lances like that shown in FIG. 3 are disposed slightly above the location of the coal burners 30. FIG. 4 shows a schematic arrangement for injecting the flyash through separate injector pipes or lances into a furnace.

Referring to FIG. 4, a flyash storage silo 45 receives ash through an inlet 46. A bag filter 47 is attached to the top of the silo 45. A coal spout 48 including a cut-off gate 49 feeds a gearmotor-type feeder blower 50 which leads to an intake tee 51. An air blower 52 also connects to the intake tee 51. Air from the blower 52 and flyash from the feeder blower 50 are carried through a steel pipe 53 to a splitter 54 which divides the flow in half and feeds two additional splitters 55 where the flow is again divided to four splitters 56 each of which feeds an injection lance 57 which enters the furnace 20. An air cylinder-operated valve 58 is disposed in each of the lines leading to an injection lance 57. A second flyash spout 60 extends from the flyash silo 45 to feed a similar injection system for the other side of the furnace 20.

The methods of the present invention provides an efficient and simple approach to solving the problems created by high LOI flyash. Useful ashes result from the methods.

I claim:

1. A method of treating high LOI bottom coal ash having an LOI greater than 5%, comprising the steps of:

introducing pulverized coal into a pulverized coal fired furnace, said pulverized coal being subbituminous coal or other coal generating low LOI ash upon burning:

introducing the high LOI bottom coal ash into the pulverized coal fired furnace in a proportion of 1% to 3.5% by weight of the pulverized coal introduced into the furnace; and reburning the high LOI coal ash in the furnace with the pulverized coal to produce a coal ash having a low LOI.

2. A method of treating high LOI bottom ash comprising the steps of:

adding the high LOI bottom ash to a supply of coal to create a bottom ash and coal mixture;

pulverizing the bottom ash and coal mixture, said supply of coal being of subbitunminous coal or other coal generating low LOI ash upon burning; and introducing the pulverized mixture into a furnace for burning to produce a coal ash having a low LOI.

3. A method of treating high LOI coal flyash, comprising the step of:

injecting a small proportion of high LOI flyash into a furnace burning pulverized coal to produce a coal ash having a low LOI, the proportion of flyash being 1% to 3.5% by weight of the pulverized coal being burned, said pulverized coal being subbitumninous coal or other coal generating low LOI ash upon burning.

4. In a method of generating steam by burning pulverized coal in a steam-generating boiler, the improvement wherein:

coal ash having an LOI greater than 5% is added to the boiler to be burned with the pulverized coal, the coal ash being added in a proportion of 1% to 3.5% by weight of the pulverized coal, said pulverized coal being subbituminous coal or other coal generating low LOI ash upon burning.

5. A method of treating high LOI flyash and high LOI bottom coal ash, comprising the steps of:

introducing pulverized coal into a pulverized coal fired furnace, said pulverized coal being subbituminous coal or other coal generating low LOI ash upon burning:

introducing the high LOI flyash and high LOI bottom coal ash into the pulverized coal fired furnace in a proportion that is about 1% to about 3.5% by weight of the pulverized coal introduced into the furnace; and reburning the high LOI flyash and high LOI bottom coal ash in the furnace with the pulverized coal to produce a coal ash having a low LOI.

* * * * *

UNITED STATES PATENT AND TRADEMARK OFFICE

CERTIFICATE OF CORRECTION

Patent No. : 5,992,336

Dated : November 30, 1999

Inventor(s) : Bruce W. Ramme

It is certified that errors appear in the above-identified patent and that said Letters Patent is hereby corrected as shown below:

Col. 6, line 10 (claim 2) after "mixture", add --, said supply of coal being of subbitunminous coal or other coal generating low LOI ash upon burning--.

Col. 6, line 11 (claim 2) after "mixture", delete <u>, said supply of coal being of subbitunminous coal or other coal generating low LOI ash upon burning</u>.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*